US007089898B2

(12) United States Patent
Tsukada

(10) Patent No.: US 7,089,898 B2
(45) Date of Patent: Aug. 15, 2006

(54) VALVE TIMING CONTROL DEVICE OF INTERNAL COMBUSTION ENGINE

(75) Inventor: Tomoya Tsukada, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/159,371

(22) Filed: Jun. 23, 2005

(65) Prior Publication Data

US 2005/0284432 A1 Dec. 29, 2005

(30) Foreign Application Priority Data

Jun. 25, 2004 (JP) ..... 2004-187186

(51) Int. Cl.
*F01L 1/34* (2006.01)

(52) U.S. Cl. ..... 123/90.17; 123/90.12; 123/90.15; 123/90.16; 123/90.31; 464/2; 464/160; 464/161

(58) Field of Classification Search ..... 123/90.17; 92/5 L
See application file for complete search history.

(56) References Cited

U.S. PATENT DOCUMENTS 6,053,139 A * 4/2000 Eguchi et al. ..... 123/90.17
6,302,072 B1 * 10/2001 Sekiya et al. ..... 123/90.17
6,332,439 B1 * 12/2001 Sekiya et al. ..... 123/90.17
6,739,298 B1 * 5/2004 Kusano et al. ..... 123/90.17
6,779,499 B1 * 8/2004 Takenaka et al. ..... 123/90.17

FOREIGN PATENT DOCUMENTS

JP 2002-357105 A 12/2002

* cited by examiner

*Primary Examiner*—Thomas Denion
*Assistant Examiner*—Kyle M. Riddle
(74) *Attorney, Agent, or Firm*—Foley & Lardner LLP

(57) ABSTRACT

In a valve timing control device, a control means is configured to carry out feeding one of retarding and advancing chambers with a hydraulic pressure upon starting of the engine; actuating one of first and second disengaging mechanisms to cancel the engagement of one of first and second projectable members with the corresponding one of first and second engaging portions; feeding the other of the retarding and advancing chambers with a hydraulic pressure to turn a vane member in a housing within a range determined by each of the first and second engaging portions; and actuating, while the vane member is under the rotational movement within the range, the other of the first and second disengaging mechanisms to cancel the engagement of the other of the first and second projectable members with the corresponding one of the first and second engaging portions.

20 Claims, 9 Drawing Sheets

VALVE TIMING CONTROL DEVICE OF INTERNAL COMBUSTION ENGINE

BACKGROUND OF THE INVENTION

1. Field of the Invention

The present invention relates to a valve timing control device of an internal combustion engine, that variably controls an open/close timing of engine valves (viz., intake and/or exhaust valves) in accordance with an operation condition of the engine.

2. Description of the Related Art

Hitherto, various valve timing control devices have been proposed and put into practical use particularly in the field of automotive internal combustion engines.

One of them is shown in Japanese Laid-open Patent Application (Tokkai) 2002-357105.

The valve timing control device of the publication generally comprises a vane member that is rotatable about its axis relative to a housing between the most retarded position and the most advanced position. For rotating the vane member in retarding or advancing direction, there are defined between the vane member and the housing retarding and advancing chambers. That is, when the retarding chambers are fed with a hydraulic pressure, the vane member is turned in a retarding direction thereby to retard the open/close operation of engine valves (viz., intake and/or exhaust valves), while when the advancing chambers are fed with the hydraulic pressure, the vane member is turned in an advancing direction thereby to advance the open/close operation of the engine valves.

The valve timing control device further comprises a rotation restricting means that restricts rotation of the vane member from a center position to the most retarded position or the most advanced position in a given condition.

The rotation restricting means comprises retarding and advancing pins that are retractably installed in respective holding bores formed in the vane member, retarding and advancing recesses that are formed in the housing and sized to receive leading ends of the retarding and advancing pins respectively, biasing springs that are respectively installed in the retarding and advancing recesses to bias the pins in a direction to project outward that is toward the retarding and advancing recesses, push back chambers that are respectively defined by the retarding and advancing recesses to push back the pins toward the holding bores against the biasing springs when fed with a hydraulic fluid and a hydraulic pressure control means that controls the pressure of the hydraulic fluid in accordance with an operation condition of the engine.

When the engine is stopped, the push back chambers are suppressed from being fed with the hydraulic fluid and thus, the retarding and advancing pins are projected into the corresponding retarding and advancing recesses due to the force of the biasing springs. With this, the vane member is held or locked at the center position.

While, when, after staring of the engine, the same is brought a predetermined operation condition, both the push back chambers are fed with a hydraulic fluid thereby to disengage the retarding and advancing pins from the corresponding recesses, and the vane member is turned in the retarding or advancing direction in the above-mentioned manner in accordance with the operation condition of the engine.

SUMMARY OF THE INVENTION

However, in the above-mentioned valve timing control device, the following phenomenon tends to occur when the engine is intended to start after long halt thereof. As is known, when the engine is at a standstill for a long time, the retarding and advancing chambers are almost empty of the hydraulic fluid.

When under such condition the engine is started, it tends to occur that the push back chambers become filled with the hydraulic pressure before the retarding and advancing chambers. That is, before the retarding and advancing chambers are sufficiently filled with the hydraulic fluid, the locked state of the vane member at the center position becomes cancelled. If, upon canceling of the locked state of the vane member, an alternating torque produced by a camshaft of the engine is transmitted to the vane member, vibration of the vane member occurs, which tends to produce an uncomfortable noise.

Of course, such undesirable phenomenon can be solved by waiting the canceling of the locked state of the vane member until the retarding and advancing chambers are sufficiently filled with the hydraulic fluid. However, in this case, another undesirable phenomenon tends to occur wherein due to the force of the hydraulic fluid in the retarding and advancing chambers and the alternating torque from the camshaft, the vane member becomes to have a certain torque and thus the retarding and advancing pins are forced to press against edges of the corresponding recesses inducing a so-called locked condition of the pins. Under such condition, canceling of the locked state of the vane member is not smoothly carried out.

It is therefore an object of the present invention to provide a valve timing control device of an internal combustion engine, which is free of the above-mentioned drawbacks.

In accordance with a first aspect of the present invention, there is provided a valve timing control device of an internal combustion engine, which comprises a rotational member that is to be driven by a crankshaft of the engine; a camshaft having thereon cam lobes for operating engine valves; a housing provided by one of the rotational member and the camshaft, the housing having hydraulic chambers defined therein; a vane member provided by the other of the rotational member and the camshaft and rotatably received in the housing, the vane member having vanes each being received in one of the hydraulic chambers to divide the same into a retarding chamber and an advancing chamber, the vane member being rotatable between the most retarded position and the most advanced position over a center position therebetween; a hydraulic circuit constructed to selectively feed a hydraulic pressure to the retarding and advancing chambers to turn the vane member in a retarding or advancing direction relative to the housing; an oil pump driven by the engine for producing the hydraulic pressure; first and second projectable members each being held by one of the housing and the vane member and biased to project toward the other of the housing and the vane member; a first engaging portion that, when engaged with the first projectable member, restricts a rotational movement of the vane member from the center position in the advancing direction and permits a rotational movement of the same by a given degree from the center position in the retarding direction; a second engaging portion that, when engaged with the second projectable member, restricts a rotation movement of the vane member from the center position in the retarding direction and permits a rotational movement of the same by a given degree from the center position in the advancing direction; a first disengaging mechanism that cancels the engagement of the first projectable member with the first engaging portion when hydraulically actuated; a second disengaging mechanism that cancels the engagement of the second projectable member with the second engaging portion when hydraulically actuated; and a control means that is configured to carry out feeding one of the retarding and advancing chambers with a hydraulic pressure upon starting of the engine; actuating one of the first and second disengaging mechanisms to cancel the engagement of one of the first and second projectable members with the corresponding one of the first and second engaging portions; feeding the other of the retarding and advancing chambers with a hydraulic pressure thereby to turn the vane member in the housing within a range determined by each of the first and second engaging portions; and actuating, while the vane member is under the rotational movement within the range, the other of the first and second disengaging mechanisms to cancel the engagement of the other of the first and second projectable members with the corresponding one of the first and second engaging portions.

In accordance with a second aspect of the present invention, there is provided a valve timing control device of an internal combustion engine, which comprises a rotational member that is to be driven by a crankshaft of the engine; a camshaft having thereon cam lobes for operating engine valves; a housing provided by one of the rotational member and the camshaft, the housing having hydraulic chambers defined therein; a vane member provided by the other of the rotational member and the camshaft and rotatably received in the housing, the vane member having vanes each being received in one of the hydraulic chambers to divide the same into a retarding chamber and an advancing chamber, the vane member being rotatable between the most retarded position and the most advanced position over a center position therebetween; a hydraulic circuit constructed to selectively feed a hydraulic pressure to the retarding and advancing chambers to turn the vane member in a retarding or advancing direction relative to the housing; an oil pump driven by the engine for producing the hydraulic pressure; first and second projectable members each being held by one of the housing and the vane member and biased by a biasing member to project toward the other of the housing and the vane member; a first engaging recess that, when engaged with the first projectable member, restricts a rotational movement of the vane member from the center position in the advancing direction and permits a rotational movement of the same by a given degree from the center position in the retarding direction; a second engaging recess that, when engaged with the second projectable member, restricts a rotational member of the vane member from the center position in the retarding direction and permits a rotational movement of the same by a given degree from the center position in the advancing direction; a biasing mechanism that is provided by at least one of the second projectable member and the second engaging recess, the biasing mechanism pressing the first projectable member against one wall of the first engaging recess when the second projectable member is brought into engagement with the second engaging recess with the aid of the biasing member; a first disengaging mechanism that cancels the engagement of the first projectable member with the first engaging recess by using the hydraulic pressure fed to the retarding chambers; a second engaging mechanism that cancels the engagement of the second projectable member with the second engaging recess by using a hydraulic pressure applied thereto; and a control means that is configured to carry out feeding the advancing chambers with a hydraulic pressure upon starting of the engine; actuating the second disengaging mechanism to cancel the engagement of the second projectable member with the second engaging recess; feeding the retarding chambers with a hydraulic pressure; and actuating the first disengaging mechanism to cancel the engagement of the first projectable member with the first engaging recess.

In accordance with a third aspect of the present invention, there is provided a valve timing control device of an internal combustion engine, which comprises a rotational member that is to be driven by a crankshaft of the engine; a camshaft having thereon cam lobes for operating engine valves; a housing provided by one of the rotational member and the camshaft, the housing having hydraulic chambers defined therein; a vane member provided by the other of the rotational member and the camshaft and rotatably received in the housing, the vane member having vanes each being received in one of the hydraulic chambers to divide the same into a retarding chamber and an advancing chamber, the vane member being rotatable between the most retarded position and the most advanced position over a center position therebetween; a hydraulic circuit constructed to selectively feed a hydraulic pressure to the retarding and advancing chambers to turn the vane member in a retarding or advancing direction relative to the housing; an oil pump driven by the engine for producing the hydraulic pressure; first and second projectable members each being held by one of the housing and the vane member and biased to project toward the other of the housing and the vane member; a first engaging means for, when engaged with the first projectable member, restricting a rotational movement of the vane member from the center position in the advancing direction and permitting a rotational movement of the same by a given degree from the center position in the retarding direction; a second engaging means for, when engaged with the second projectable member, restricting a rotation movement of the vane member from the center position in the retarding direction and permitting a rotational movement of the same by a given degree from the center position in the advancing direction; a first disengaging means for canceling the engagement of the first projectable member with the first engaging means when hydraulically actuated; a second disengaging means for canceling the engagement of the second projectable member with the second engaging means when hydraulically actuated; and a control means that is configured to carry out feeding one of the retarding and advancing chambers with a hydraulic pressure upon starting of the engine; actuating one of the first and second disengaging means to cancel the engagement of one of the first and second projectable members with the corresponding one of the first and second engaging means; feeding the other of the retarding and advancing chambers with a hydraulic pressure thereby to turn the vane member in the housing within a range determined by each of the first and second engaging means; and actuating, while the vane member is under the rotational movement within the range, the other of the first and second disengaging means to cancel the engagement of the other of the first and second projectable members with the corresponding one of the first and second engaging means.

Other objects and advantages of the present invention will become apparent from the following description when taken in conjunction with the accompanying drawings.

DETAILED DESCRIPTION OF THE INVENTION

In the following, a valve timing control device 100 of the present invention will be described in detail with reference to the accompanying drawings.

As will become apparent from the following, valve timing control device 100 is a device that controls the open/close timing of intake valves of an associated internal combustion engine.

For ease of understanding, various directional terms, such as, right, left, upper, lower, rightward, etc., are used in the following description. However, such terms are to be understood with respect to only a drawing or drawings on which the corresponding part or portion is shown.

Figure 1:
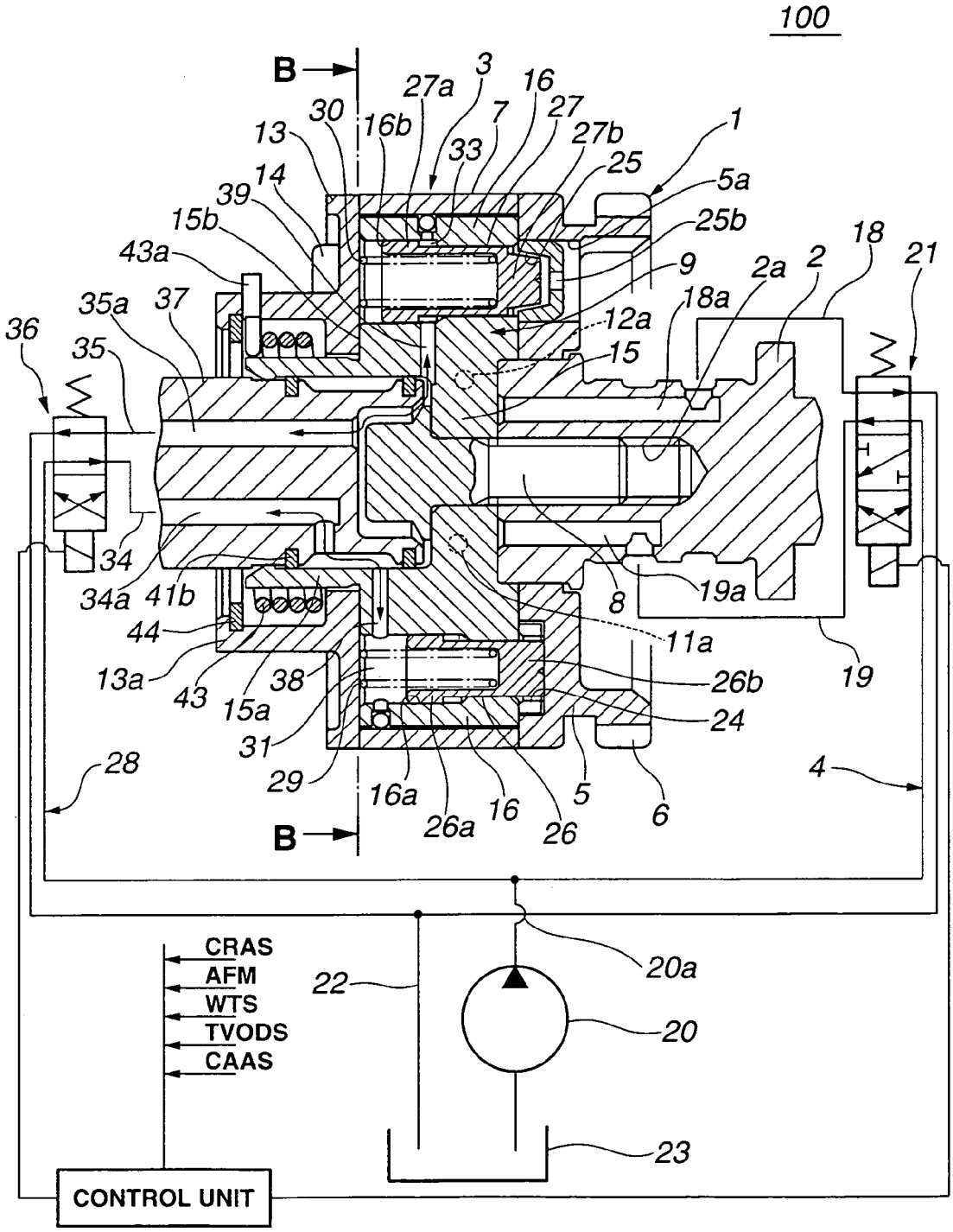
FIG. 1 is a sectional view of an essential portion of a valve timing control device of the present invention.

Referring to FIG. 1 of the drawings, there is shown in a sectional manner a valve timing control device 100 of the present invention.

Valve timing control device 100 generally comprises a sprocket 1 that is driven by a crankshaft of an associated internal combustion engine through a timing chain, an intake camshaft 2 that extends along an axis of the engine and is concentrically disposed in sprocket 1 in a manner to permit a relative rotation therebetween, a phase change mechanism 3 that is arranged between sprocket 1 and intake camshaft 2 to change a relative angular positioning therebetween and a hydraulic circuit 4 that actuates the phase change mechanism 3.

Figure 2:
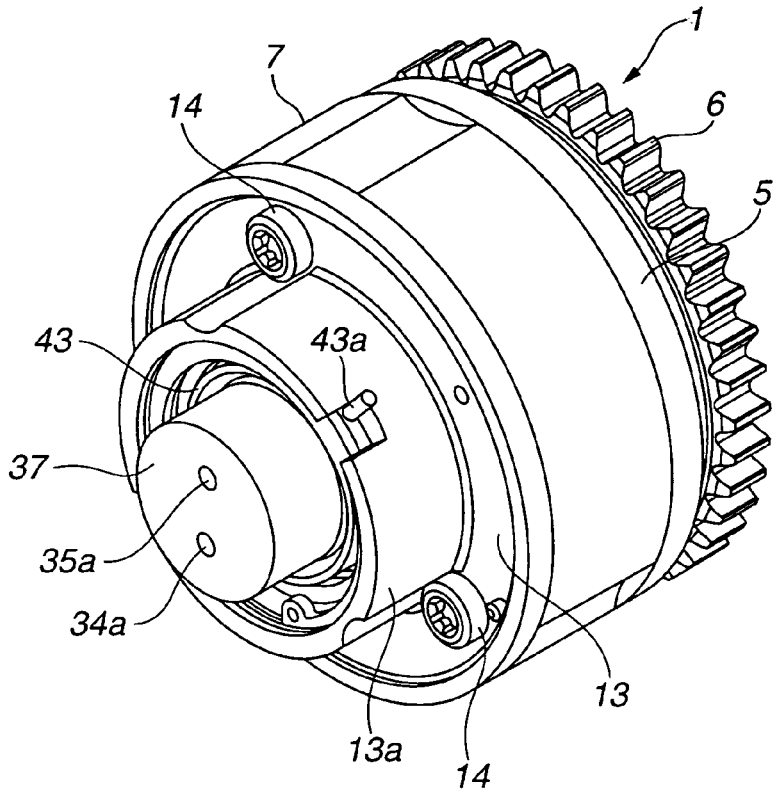
FIG. 2 is a perspective view of the valve timing control device of the present invention.

As is seen from FIGS. 1 and 2, sprocket 1 comprises a cylindrical body portion 5 that has a thicker wall and a gear portion 6 that is integrally formed on one axial edge of cylindrical body portion 5. Although not shown in the drawings, the timing chain is put on and engaged with gear portion 6 to drive sprocket 1. Cylindrical body portion 5 constitutes a rear cover that closes a rear open end of an after-mentioned housing.

As is seen from FIG. 1, cylindrical body portion 5 is formed at a radially outer part with an axially extending through bore 5*a*.

Intake camshaft 2 is rotatably supported on a cylinder head (not shown) through bearings and has thereon a plurality of axially spaced cams for actuating intake valves (viz., engine valves) of the associated internal combustion engine. As shown in FIG. 1, intake camshaft 2 is formed at its left end with an internally threaded center bore 2*a*.

Figure 3:
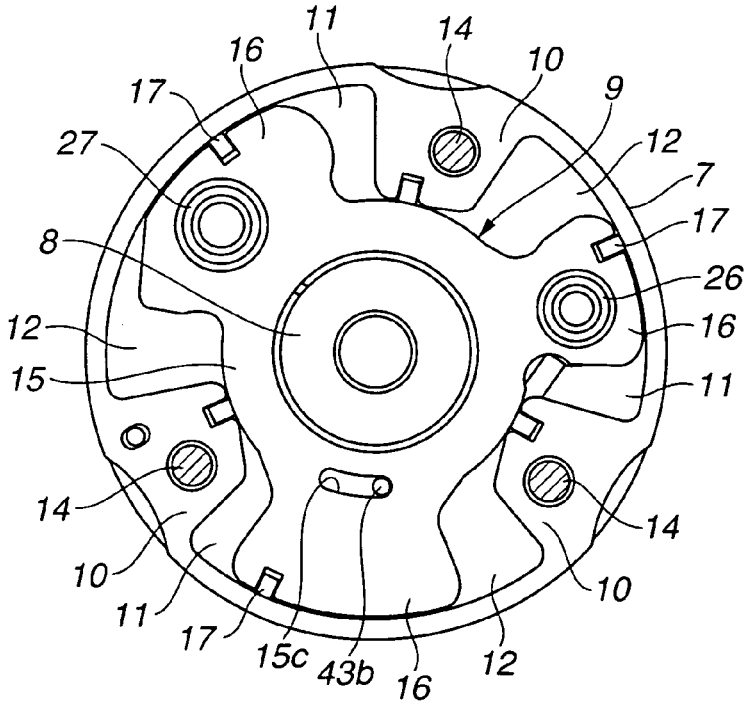
FIG. 3 is a sectional view of the valve timing control device of the present invention, showing a condition wherein a vane member is held in a center position.

As is seen from FIGS. 1 and 3, phase change mechanism 3 comprises a cylindrical housing 7 integrally and coaxially connected to sprocket 1, a vane member 9 that is coaxially fixed to the left end of intake camshaft 2 through a cam bolt 8 engaged with threaded center bore 2*a* and rotatably installed in the above-mentioned cylindrical housing 7, three retarding chambers 11 (see FIG. 3) that are defined at clockwise sides between three inwardly projected partition portions 10 of housing 7 and three outwardly projected vanes 16 of vane member 9 and three advancing chambers 12 that are defined at counterclockwise sides between three inwardly projected partition portions 10 of housing 7 and three outwardly projected vanes 16 of vane member 9.

Referring back to FIG. 1, cylindrical housing 7 comprises a cylindrical body, a generally annular front cover 13 that covers a front (or left) open end of the cylindrical body, and the above-mentioned sprocket 1 that covers the rear open end of the cylindrical body.

As is seen from FIGS. 1, 2 and 3, the housing body, annular front cover 13 and body portion 5 of sprocket 1 are united tightly by means of three bolts 14 that pass through the three inwardly projected partition portions 10 of housing 7.

As is seen from FIG. 2, annular front cover 13 is integrally formed at its left center part with a smaller diameter cylindrical portion 13*a*.

As is seen from FIGS. 1 and 3, vane member 9 is constructed of a metal and comprises a rotor portion 15 that is fixed to the end of intake camshaft 2 by cam bolt 8 and three vanes 16 that project radially outward from rotor portion 15 at equally spaced intervals (viz., 120 degrees).

As is seen from FIG. 1, rotor portion 15 of vane member 9 is cylindrical in shape and integrally formed at a left end with a smaller diameter cylindrical supporting portion 15*a*. Between this supporting portion 15*a* and rotor portion 15, there is defined a stepped surface 15*b*. As shown, the above-mentioned front cover 13 is rotatably disposed on cylindrical supporting portion 15*a* while being in contact with stepped surface 15*b*.

As shown in FIG. 3, each vane 16 of vane member 9 is placed between two adjacent partition portions 10 of housing 7 and provided at a top portion thereof with a sealing member 17 for sealing between the top portion and an inner surface of the cylindrical body of housing 7.

As shown in the drawing, each partition portions 10 of housing 7 has at one side one retarding chamber 11 and at the other side one advancing chamber 12.

As is seen from FIG. 1, the three retarding chambers 11 are connected through first connecting passages 11*a* formed in rotor portion 15 of vane member 9, and the three advancing chambers 12 are connected through second connecting passages 12*a* formed also in rotor portion 15 of vane member 9.

As is seen from FIG. 1, hydraulic circuit 4 is constructed to selectively feed the hydraulic fluid (or pressure) to retarding and advancing chambers 11 and 12. That is, hydraulic circuit 4 comprises a retarding fluid passage 18 that connects to retarding chambers 11 through first connecting passages 11*a*, an advancing fluid passage 19 that connects to advancing chambers 12 through second connecting passages 12*a*, an oil pump 20 that selectively feeds the retarding and advancing fluid passages 18 and 19 with a hydraulic fluid (or hydraulic pressure) and a first electromagnetic switch 21 that switches the flow directions of the retarding and advancing fluid passages 18 and 19 in accordance with an operation condition of the associated engine. Oil pump 20 may be a common pump such as a trochoide pump or the like that is powered by the engine.

As shown in FIG. 1, retarding and advancing fluid passages 18 and 19 have one ends that are connected to inlet/outlet openings of first electromagnetic switch 21 and the other ends 18*a* and 19*a* that are connected to the above-mentioned first and second connecting passages 11*a* and 12*a* through respective passages (no numerals) formed in intake camshaft 2.

As is seen from FIG. 1, first electromagnetic switch 21 is of a three position proportional type and comprises a valve body, a spool axially movably installed in the valve body and an electromagnet. The axial movement of the spool is controlled by a control unit (not shown) in such a manner as to connect an outlet passage 20*a* of oil pump 20 to either one of retarding and advancing fluid passages 18 and 19 and at the same time connect a drain passage 22 to the other of the fluid passages 18 and 19. As shown, an inlet part of oil pump 20 and terminal part of drain passage 22 are led to an interior of an oil pan 23.

Information signals from a crank angle sensor (CRAS), an air flow meter (AFM), a water temperature sensor (WTS), a throttle valve open degree sensor (TVODS), a cam angle sensor (CAAS), etc., are fed to the control unit to detect a current operation condition of the engine. Based on the current operation condition of the engine, the control unit outputs instruction signals to first electromagnetic switch 21 and an after-mentioned second electromagnetic switch 36. The crank angle sensor senses a crank angle of the engine (viz., engine speed), the air flow meter senses an air flow rate in an air induction part of the engine, the water temperature sensor senses the temperature of the engine cooling water, the throttle valve open degree sensor senses an open degree of a throttle valve arranged in the air induction part of the engine, and the cam angle sensor senses an angle shown by intake camshaft 2.

As is seen from FIGS. 1 and 3, valve timing control device further comprises a rotation restricting means that is able to hold vane member 9 at a center position relative to cylindrical housing 7, that is, a center position between the most retarded position and the most advanced position.

As is seen from FIGS. 1 and 3, rotation restricting means generally comprises first and second engaging recesses 24 and 25 that are formed in mutually spaced parts of cylindrical body portion 5 of sprocket 1, and first and second engaging pins 26 and 27 that are axially movably received in respective bores formed in the two vanes 16 of the vane member 9 and arranged to be engageable with first and second engaging recesses 24 and 25, and a hydraulic control mechanism 28 that operates to selectively establish and cancel the engagement between first and second engaging pins 26 and 27 and first and second engaging recesses 24 and 25.

Figure 4:
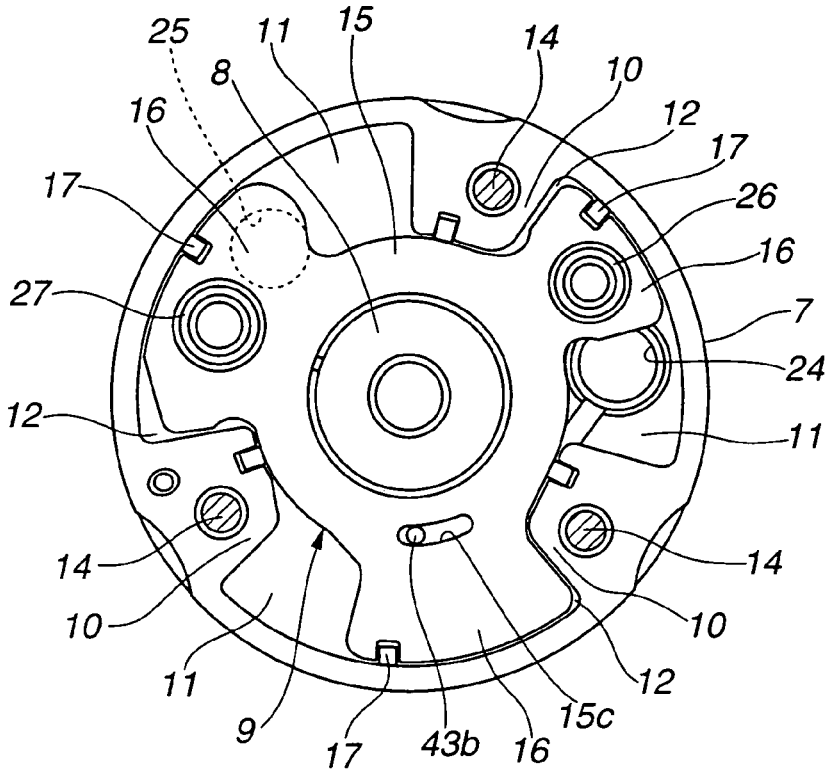
FIG. 4 is a view similar to FIG. 3, but showing a condition wherein the vane member is held in a retarded position.

As is seen from FIG. 4, first engaging recess 24 of body portion 5 of sprocket 1 is provided at a somewhat advancing position with respect to the most retarded position of vane member 9.

Figure 6:
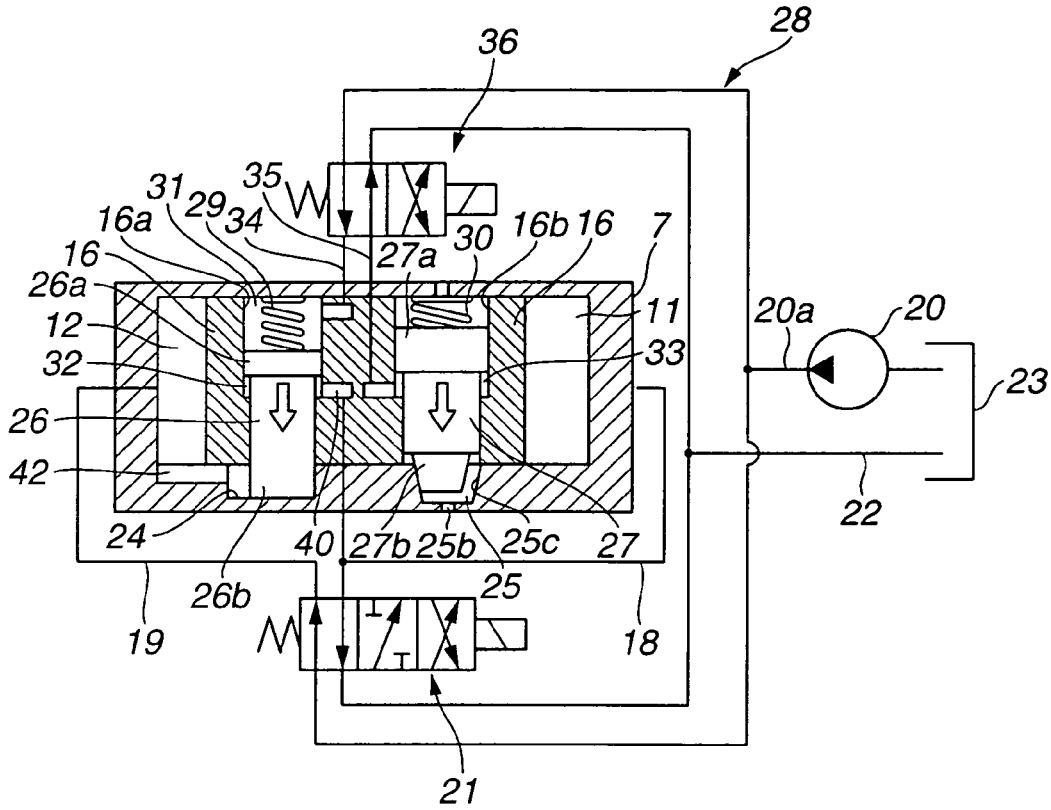
FIG. 6 is a schematically illustrated rotation restricting means employed in the present invention, showing a condition of the means when an associated engine is at a standstill.

As is seen from FIG. 6, the diameter of first engaging recess 24 is larger than that of the leading portion 26*b* of first engaging pin 26, and thus, the pin 26 is permitted to move slightly in a circumferential direction in engaging recess 24 even when engaged with recess 24.

As is understood from FIGS. 4 and 6, also second engaging recess 25 is provided at a somewhat advancing position with respect to the most retarded position of vane member 9. That is, when first engaging pin 26 is in engagement with first engaging recess 24, second engaging pin 27 takes a position engageable with second engaging recess 25.

As is seen from FIG. 6, the recess 25 is a tapered recess with a conical inner surface 25*c*. As shown, the recess 25 is communicated with the outside through an air vent passage 25*b* formed in a bottom of the recess 25. Due to provision of this passage 25*b*, engagement and disengagement of second engaging pin 27 with or from the recess 25 are facilitated.

As is seen from FIG. 1, first engaging pin 26 is axially movably received in a first pin bore 16*a* formed in one of the three vanes 16 of vane member 9, and has at its left part a larger diameter land portion 26*a* that serves as a pressure receiving part and at its right part a cylindrical portion 26*b* that has a flat right end. As shown, a first coil spring 29 is compressed between first engaging pin 26 and an inner surface of front cover 13 to bias the pin 26 rightward, that is, in a direction to establish the engagement between the pin 26 and first engaging recess 24. The pin 26 has an axially extending blind bore for receiving a right part of the spring 29.

As is seen from FIG. 1, second engaging pin 27 is axially movably received in a second pin bore 16*b* formed in the other one of the three vanes 16 of vane member 9, and has at its left part a larger land portion 27*a* that serves as a pressure receiving part and at its right part a cylindrical portion that has a conical right end 27*b*.

As is seen from FIG. 6, the size of conical right end 27*b* of second engaging pin 27 is smaller than that of conical second engaging recess 25, and thus, the pin 27 is permitted to move slightly in a circumferential direction in the recess 25 even when engaged with the recess 25.

It is to be noted that, due to the conical shape that both end 27*b* of pin 27 and recess 25 have, ingress and egress of end 27*b* into and from recess 25 induce a slight rotation of vane member 9 about its axis relative to cylindrical housing 7.

Referring back to FIG. 1, a second coil spring 30 is compressed between second engaging pin 27 and the inner surface of front cover 13 to bias the pin 27 rightward, that is, in a direction to establish the engagement between the pin 27 and second engaging recess 25. Like the above-mentioned first engaging pin 26, the second pin 27 has an axially extending blind bore for receiving a right part of the spring 30.

As is seen from FIG. 1, hydraulic control mechanism 28 comprises a pin engaging chamber 31 that is merged with the left part of first pin bore 16*a* in which first coil spring 29 is installed, a first pin disengaging chamber 32 that is defined between a stepped part of first pin bore 16*a* and larger diameter land portion 26*a* of first engaging pin 26, a second pin disengaging chamber 33 that is defined between a stepped part of second pin bore 16*b* and larger diameter land portion 27*a* of second engaging pin 27, a first fluid passage 34 that extends between pin engaging chamber 31 and either one of outlet passage 20*a* of oil pump 20 and drain passage 22, a second fluid passage 35 that extends between second pin disengaging chamber 33 and either one of outlet passage 20*a* and drain passage 22, and a second electromagnetic switch 36 that switches first and second fluid passages 34 and 35 for connection with oil outlet passage 20*a* or drain passage 22 in accordance with an instruction signal applied thereto from the control unit, that is, in accordance with an operation condition of the engine.

As is easily understood from FIG. 6, pin engaging chamber 31 is constructed to bias first engaging pin 26 toward first engaging recess 24 with both a force that is possessed by the hydraulic pressure fed thereto from oil pump 20 through first fluid passage 34 and a force that is produced by first coil spring 29.

While, first and second pin disengaging chambers 32 and 33 are each constructed to bias first or second engaging pin 26 or 27 against the biasing force of first or second coil spring 29 or 30 in a direction away from first or second engaging recess 24 or 25 with a force that is possessed by the hydraulic pressure fed thereto from oil pump 20. As will be described in detail hereinafter, application of the hydraulic pressure to first and second pin disengaging chambers 32 and 33 is made together with application of the same to retarding or advancing chamber 11 or 12.

As is seen from FIG. 1, first fluid passage 34 has one end that is connected to an inlet/outlet opening of second electromagnetic switch 36 and the other end that is connected to pin engaging chamber 31 through a first axial passage 34*a* formed in a cylindrical supporting rod 37 and a first radial passage 38 formed in vane member 9, while second fluid passage 35 has one end that is connected to the other inlet/outlet opening of second electromagnetic switch 36 and the other end that is connected to second pin disengaging chamber 33 through a second axial passage 35*a* formed in cylindrical supporting rod 37 and a second radial passage 39 formed in vane member 9.

It is to be noted that, as will be seen from FIG. 6, the hydraulic pressure fed to one retarding chamber 11 is also fed to first pin disengaging chamber 32 through a connecting passage 40 formed in vane member 9.

Second electromagnetic switch 36 is of a two-position ON/OFF type and comprises a valve body, a spool axially movably installed in the valve body and an electromagnet. The axial movement of the spool is controlled by the above-mentioned control unit in such a manner as to connect outlet passage 20*a* of oil pump 20 to either one of first and second fluid passages 34 and 35 and at the same time connect drain passage 22 to the other of passages 34 and 35.

As is seen from FIG. 1, between a cylindrical clearance between an outer surface of cylindrical supporting rod 37 and an inner surface of cylindrical supporting portion 15*a* of rotor portion 15 of vane member 9, there are operatively arranged two seal rings 41*a* and 41*b*.

Figure 7:
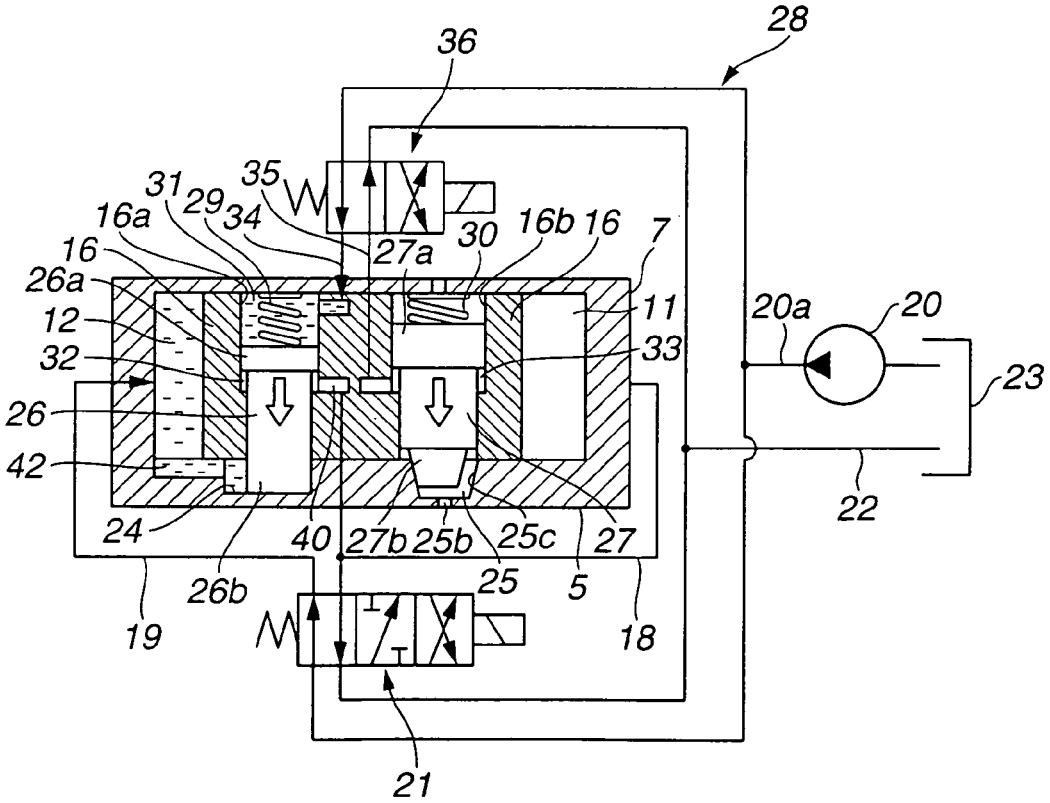
FIG. 7 is a view similar to FIG. 6, but showing a condition taken when an oil pump becomes powered by a cranking operation of the engine.

As is seen from FIG. 6, first engaging recess 24 of rotation restricting means is communicated with one of advancing chambers 12 through a connecting passage 42 formed in vane member 9. As is seen from the drawing, connecting passage 42 extends radially outward from first engaging recess 24, and thus, when, with first engaging pin 26 kept in engagement with recess 24, a hydraulic pressure is applied to connecting passage 42, there is produced a force by which leading end 26*b* of pin 26 is pressed against a side wall of recess 24. This will be much well understood from FIG. 7.

Referring back to FIG. 1, around cylindrical supporting portion 15*a* of rotor portion 15 of vane member 9, there is disposed a coil spring 43 that functions to bias vane member 9 in a direction from the most retarded position to the center position relative to cylindrical housing 7. For this biasing action, coil spring 43 has one end 43*a* (see FIG. 2) hooked to a recess formed in cylindrical portion 13*a* of annular front cover 13 and the other end 43*b* engaged with an elongate slot 15*c* (see FIG. 3) formed in rotor portion 15 of vane member 9.

As shown in FIG. 1, within cylindrical portion 13*a* of annular front cover 13, there is tightly installed a stopper ring 44 by which a left end of coil spring 43 is held.

In the following, operation of valve timing control device 100 of the present invention will be described with reference to the drawings, particularly FIGS. 3 to 5 and 6 to 13.

For ease of understanding, the description will be commenced with respect to a standstill condition of the associated engine.

Under such condition, vane member 9 assumes the center position as shown in FIG. 3. In this case, oil pump 20 does not work, and thus, as is seen from FIG. 6, all of the three retarding chambers 11, three advancing chambers 12, first and second engaging recesses 24 and 25, pin engaging chamber 31 and first and second pin disengaging chambers 32 and 33 are not supplied with a sufficient hydraulic pressure. Thus, first and second engaging pins 26 and 27 are engaged at their leading ends 26*b* and 27*b* with first and second engaging recesses 24 and 25 respectively with the biasing force of first and second coil springs 29 and 30. That is, the center position of vane member 9 is substantially locked.

Under this condition, first electromagnetic switch 21 assumes a condition wherein due to the force of a spring (no numeral), the spool is forced to take one position to connect outlet passage 20*a* of oil pump 20 to advancing fluid passage 19 and connect drain passage 22 to retarding fluid passage 18, and at the same time, second electromagnetic switch 36 assumes a condition wherein due to the force of a spring (no numeral), the spool is forced to take one position to connect outlet passage 20*a* of oil pump 20 to first fluid passage 34 and connect drain passage 22 to second fluid passage 35.

When now an ignition switch (not shown) of the engine is turned ON, oil pump 20 becomes powered by the cranking of the engine. Upon this, as is seen from FIG. 7, a certain amount of hydraulic fluid is led to pin engaging chamber 31 through first fluid passage 34, and also to first engaging recess 24 through one advancing chamber 12 and connecting passage 42. With this fluid supply, the engagement between first engaging pin 26 and first engaging recess 24 becomes much tightly made, while the engagement between second engaging pin 27 and second engaging recess 25 is kept without change in engaging force.

Figure 8:
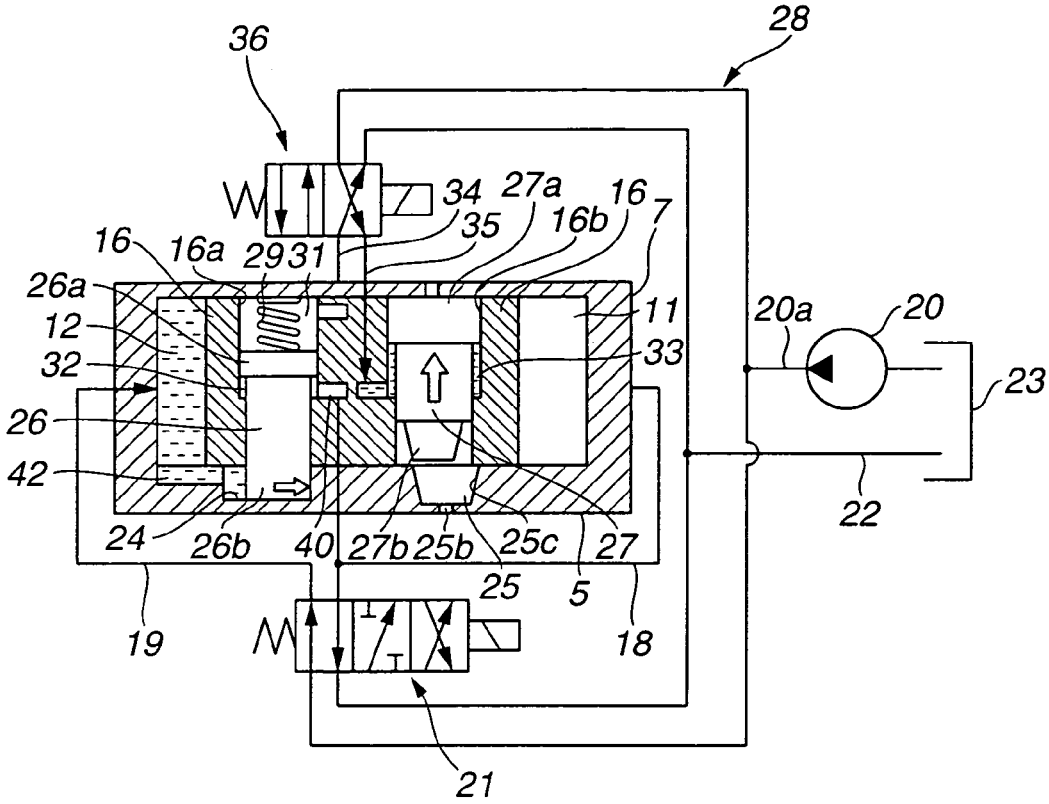
FIG. 8 is a view similar to FIG. 6, but showing a condition taken just after the cranking operation of the engine.

When, after completion of the cranking, the engine takes a transit condition just before starting its idling operation, hydraulic control mechanism 28 takes such a condition as depicted by FIG. 8. That is, upon such condition, an instruction signal is fed from the control unit to second electromagnetic switch 36 causing the same to take another condition wherein the spool takes the other position to connect drain passage 22 to first fluid passage 34 and connect outlet passage 20*a* of oil pump 20 to second fluid passage 35. With this, pin engaging chamber 31 is subjected to a pressure decrease and second pin disengaging chamber 33 is subjected to a pressure increase, so that second engaging pin 27 is smoothly disengaged from second engaging recess 25 canceling the engagement therebetween.

While, under this condition, first engaging pin 26 keeps the engagement with first engaging recess 24 because leading end 26*b* of pin 26 is pressed against a side wall of recess 24 by the force produced by the hydraulic fluid in connecting passage 42.

It is to be noted that, as is seen from FIG. 8, since leading end 26*b* of first engaging pin 26 has the flat end intimately pressed against a flat bottom of first engaging recess 24, the hydraulic fluid in connecting passage 42 does not produce a force to bias pin 26 in a direction away from recess 24.

As is described hereinabove, until the time depicted by FIG. 8, at least first engaging pin 26 keeps the engagement with first engaging recess 24, and thus, vane member 9 keeps the center position relative to cylindrical housing 7. This means improvement in engine starting performance.

Figure 9:
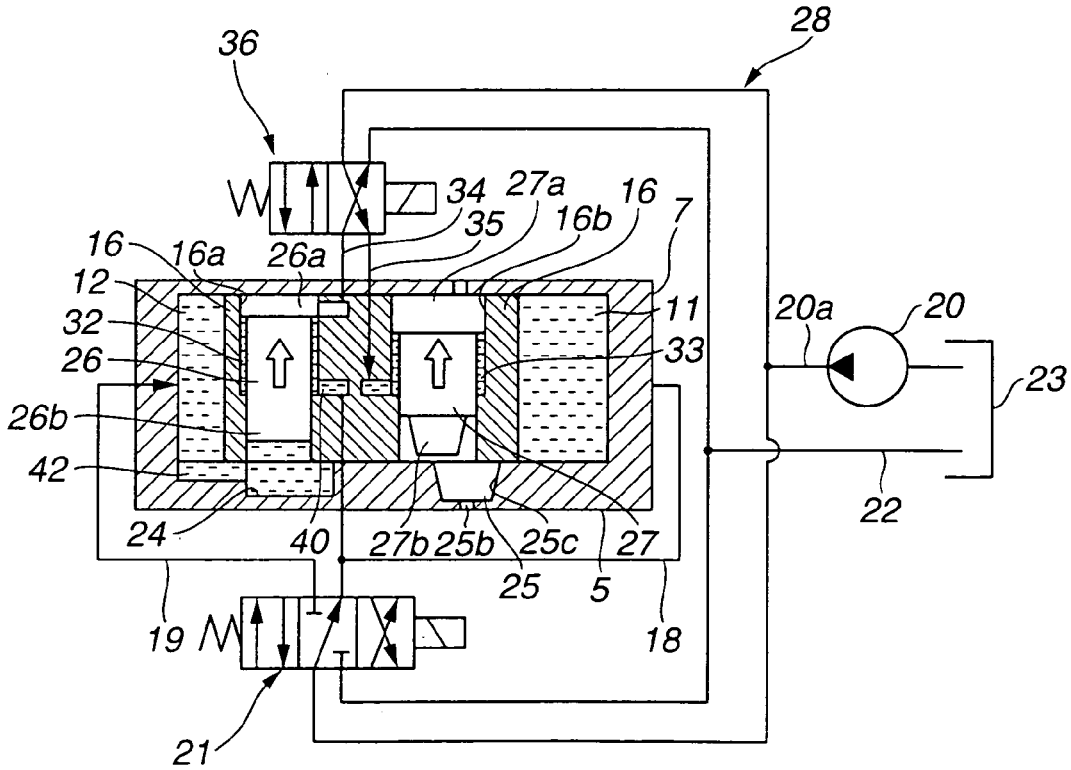
FIG. 9 is a view similar to FIG. 6, but showing a condition taken when the engine is under idling.

When now the engine is started and brought to an idling operation, hydraulic control mechanism 28 takes such a condition is as depicted by FIG. 9. Second electromagnetic switch 36 is kept unchanged. However, in this case, an instruction signal is fed from the control unit to first electromagnetic switch 21 causing the same to take a condition wherein the spool takes a position to close advancing fluid passage 19 to keep the pressure in three advancing chambers 12 and connect outlet passage 20*a* of oil pump 20 to retarding fluid passage 18.

With this, retarding chambers 11 are subjected to a pressure increase causing vane member 9 to turn slightly in a phase retarding direction, and thus, first engaging pin 26 is moved slightly in first engaging recess 24 in a direction to cancel the intimate contact of leading end 26*b* thereof with the inner wall of recess 24.

At the same time, the hydraulic pressure is fed to first pin disengaging chamber 32 through connecting passage 40. With this, first engaging pin 26 that has been released from the side wall of first engaging recess 24 is smoothly and fully disengaged from the recess 24 canceling the engagement therebetween.

Thus, now, vane member 9 is unlocked and thus permitted to rotate in both, that is, retarding and advancing directions relative to cylindrical housing 7.

Figure 10:
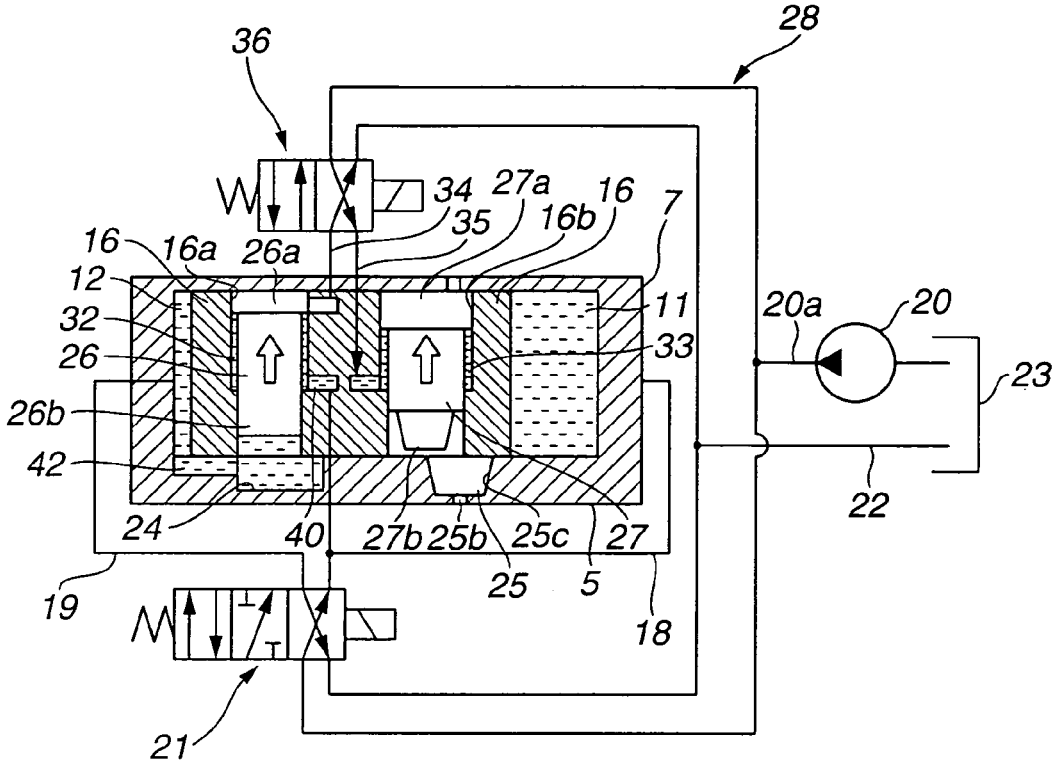
FIG. 10 is a view similar to FIG. 6, but showing a condition taken when the engine is under a phase retarded control.

When thereafter the engine is brought to for example a lower speed lower load operation mode, hydraulic control mechanism 28 takes such a condition as depicted by FIG. 10. That is, upon this operation change, an instruction signal is fed from the control unit to first electromagnetic switch 21 causing the same to take a condition wherein the spool takes a position to connect drain passage 22 to advancing fluid passage 19 and connect outlet passage 20*a* of oil pump 20 to retarding fluid passage 18. Actually, the connection between outlet passage 20*a* and retarding fluid passage 18 is kept from the previous condition.

With this, as is seen from FIG. 4, the hydraulic pressure in three advancing chambers 12 is reduced and at the same time the hydraulic pressure in three retarding chambers 11 is increased, and thus, vane member 9 is turned to the most retarded position relative to cylindrical housing 7. This means that intake camshaft 2 is turned to the most retarded position relative to sprocket 1 thereby reducing the overlap between intake and exhaust valves. Thus, a residual gas in each cylinder is reduced inducing improvement in combustion efficiency, stability in rotation and improvement in fuel consumption.

Figure 11:
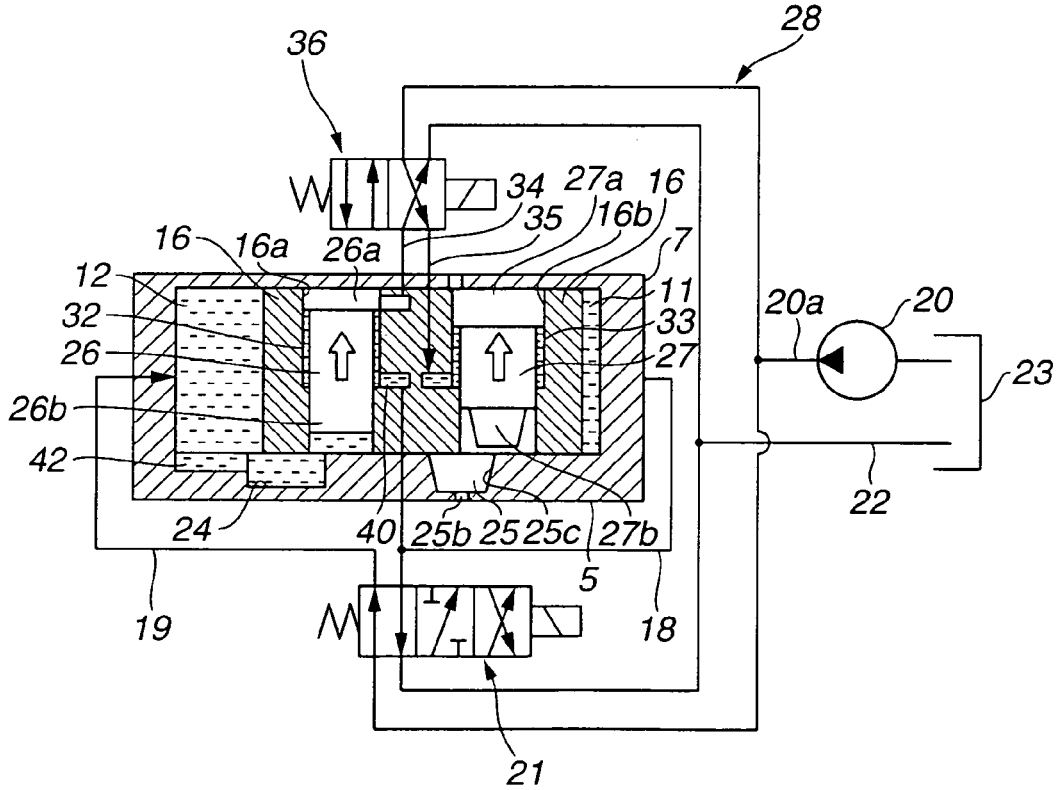
FIG. 11 is a view similar to FIG. 6, but showing a condition taken when the engine is under a phase advanced control.

When thereafter the engine is brought to for example a higher speed higher load operation mode, hydraulic control mechanism 28 takes such a condition as depicted by FIG. 11. That is, upon this operation change, an instruction signal is fed from the control unit to first electromagnetic switch 21 causing the same to take a condition wherein the spool takes a position to outlet passage 20*a* of oil pump 20 to advancing fluid passage 19 and connect drain passage 22 to retarding fluid passage 18.

Figure 5:
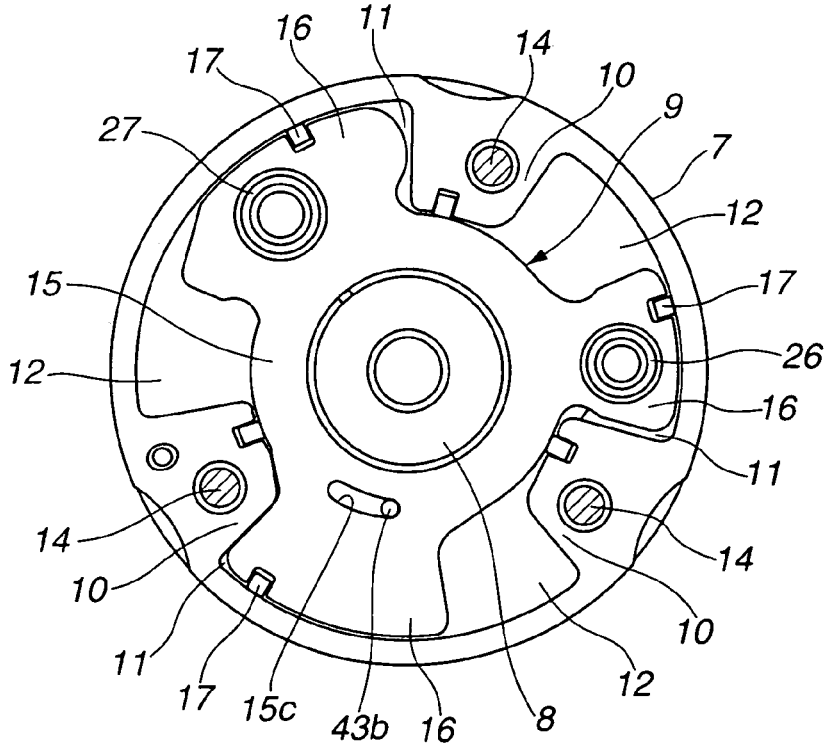
FIG. 5 is a view also similar to FIG. 3, but showing a condition wherein the vane member is held in an advanced position.

With this, as is seen from FIG. 5, the hydraulic pressure in three advancing chambers 12 is increased and at the same time the hydraulic pressure in three retarding chambers 11 is reduced, and thus, vane member 9 is turned to the most advanced position relative to cylindrical housing 7. This means that intake camshaft 2 is turned to the most advanced position relative to sprocket 1 thereby increasing the overlap between intake and exhaust valves. Thus, the air charging efficiency of each cylinder is increased and the output torque of the engine is increased.

When it is intended to stop engine, the associated motor vehicle is brought into its standstill causing the engine to take an idling condition. Thus, under this condition, vane member 9 is returned to the center position (see FIG. 3) for the reason as has been explained in the section of FIG. 9.

Figure 12:
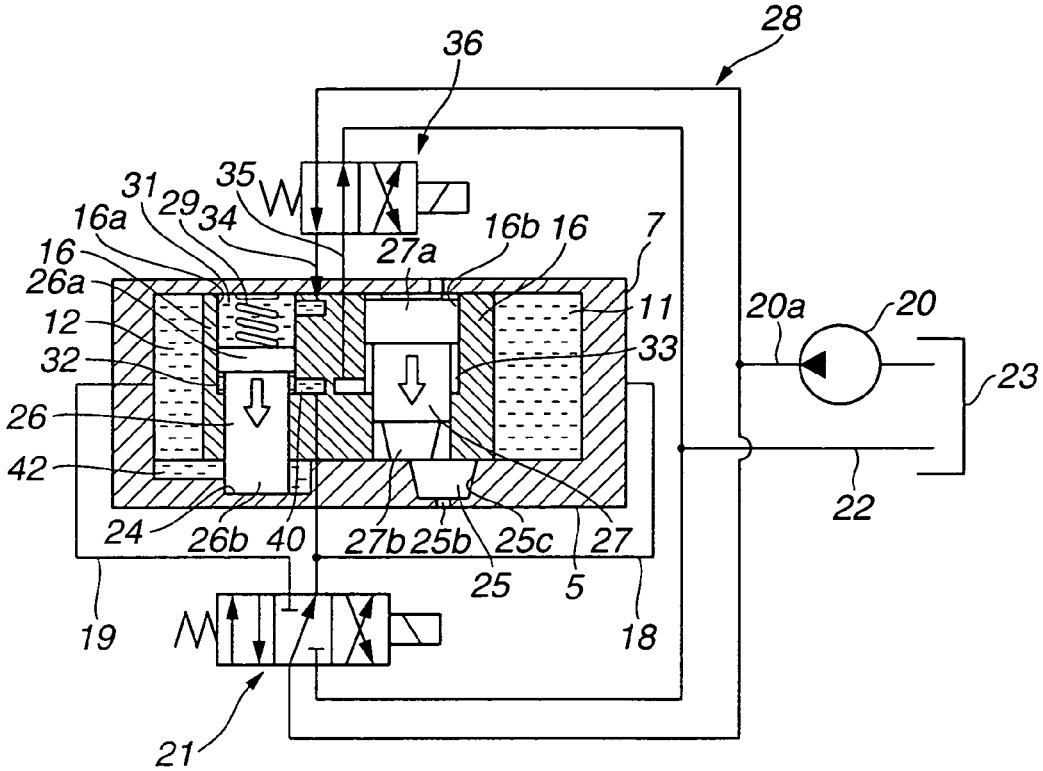
FIG. 12 is a view similar to FIG. 6, but showing a condition taken when the engine assumes a stand-by condition for stopping.

When now an ignition switch is turned OFF, hydraulic control mechanism 28 takes such a condition as depicted by FIG. 12. That is, in a short period for which the engine still rotates slowly before its complete stopping, an instruction signal is fed from the control unit to first electromagnetic switch 21 causing the same to take a condition wherein the spool takes a position to block advancing fluid passage 19 and connect outlet passage 20*a* of oil pump 20 to retarding fluid passage 18. Because, under such slow rotation of the engine, the hydraulic pressure from outlet passage 20*a* is very small and thus vane member 9 is slightly moved from the center position to a slightly retarded position.

In the above-mentioned short period, an instruction signal is fed from the control unit to second electromagnetic switch 36 causing the same to take a condition wherein the spool takes a position to connect outlet passage 20*a* of oil pump 20 to first fluid passage 34 and connect drain passage 22 to second fluid passage 35.

Accordingly, first engaging pin 26 is forced to move into first engaging recess 24 to establish a locked engagement therebetween. For the reason as is mentioned hereinabove, that is, because vane member 9 assumes the slightly retarded position, first engaging pin 26 engaged with recess 24 takes a retarded position relative to recess 24. Thus, as is seen from the drawing, second engaging pin 27 fails to engage with second engaging recess 25 while being biased toward recess 25 due to the force of second coil spring 30.

Figure 13:
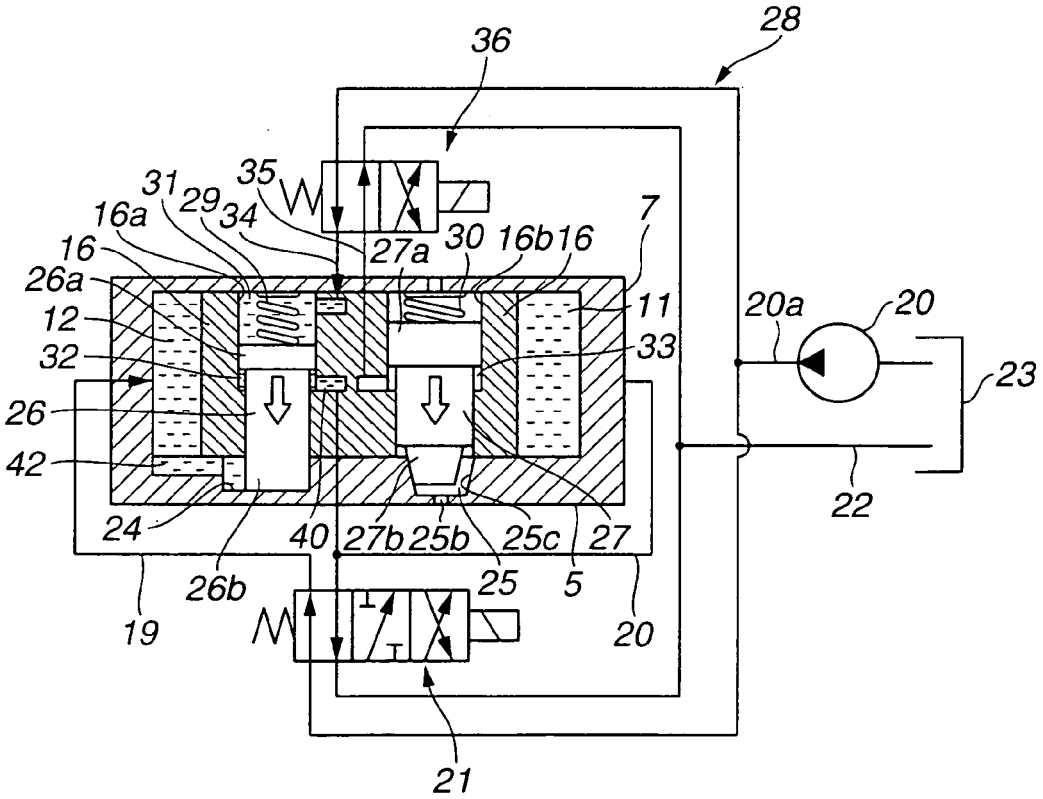
FIG. 13 is a view similar to FIG. 6, but showing a condition taken when the engine stops after the stand-by condition.

Just before the complete stopping of the engine, hydraulic control mechanism 28 takes such a condition as depicted by FIG. 13. That is, due to the work of the control unit, first electromagnetic switch 21 is forced to assume a condition wherein the spool takes a position to connect outlet passage 20*a* of oil pump 20 to advancing fluid passage 19 and connect drain passage 22 to retarding fluid passage 18.

With this, three advancing chambers 12 become higher in pressure causing vane member 9 to turn back slightly in the advancing direction to the center position having leading end 26*b* of first engaging pin 26 slide on the flat bottom of first engaging recess 24. With this slight rotation of vane member 9, second engaging pin 27 is permitted to engage with second engaging recess 25, as shown. Thus, vane member 9 is fully locked at the center position by the two engaging pins 26 and 27, as shown in FIGS. 3 and 13.

As is described hereinabove, in accordance with the present invention, at the time of staring the engine, disengagement of first and second engaging pins 26 and 27 from their corresponding first and second engaging recesses 24 and 25 is not simultaneously carried out. During a time from the engine cranking to the time just before the engine idling operation, only the disengagement of second engaging pin 27 from second engaging recess 25 is carried out. That is, during the time, first engaging pin 26 is forced to keep the engagement with first engaging recess 24 having leading end 26*b* pressed against the side wall of first engaging recess 24. At the time when retarding or advancing chambers 11 or 12 are filled with the hydraulic pressure, the disengagement of first engaging pin 26 from first engaging recess 24 is carried out. Accordingly, undesired vibration of vane member 9, which would be caused by an alternating torque applied thereto at the engine starting, is sufficiently suppressed.

For keeping the engagement of first engaging pin 26 with first engaging recess 24, leading end 26*b* of pin 26 is tightly pressed against the side wall of recess 24. That is, a frictional force produced between leading end 26*b* and the side wall suppresses the disengagement of pin 26 from recess 24.

In the period from the OFF turning of the ignition switch to the complete stop of the engine, first engaging pin 26 is brought into engagement with first engaging recess 24 at first and then second engaging pin 27 is brought into engagment with second engaging recess 25. This two step action brings about an assured locking of vane member 9 to sprocket 1 at the center position, and thus, undesired vibration of vane member 9 is assuredly suppressed.

Because of usage of two engaging pins 26 and 27, positioning of vane member 9 relative to sprocket 1 is assured at the time of starting the engine, and thus, the engine starting performance is improved.

Because of the conical shape that both leading end 27*b* of second engaging pin 27 and second engaging recess 25 have, the engagement and disengagement between leading end 27*b* and recess 25 are easily and assuredly made.

In the following, three, viz., first, second and third methods for determining the timing of disengaging second engaging pin 27 from second engaging recess 25 at the engine starting will be described with reference to FIGS. 14 to 16.

Figure 14:
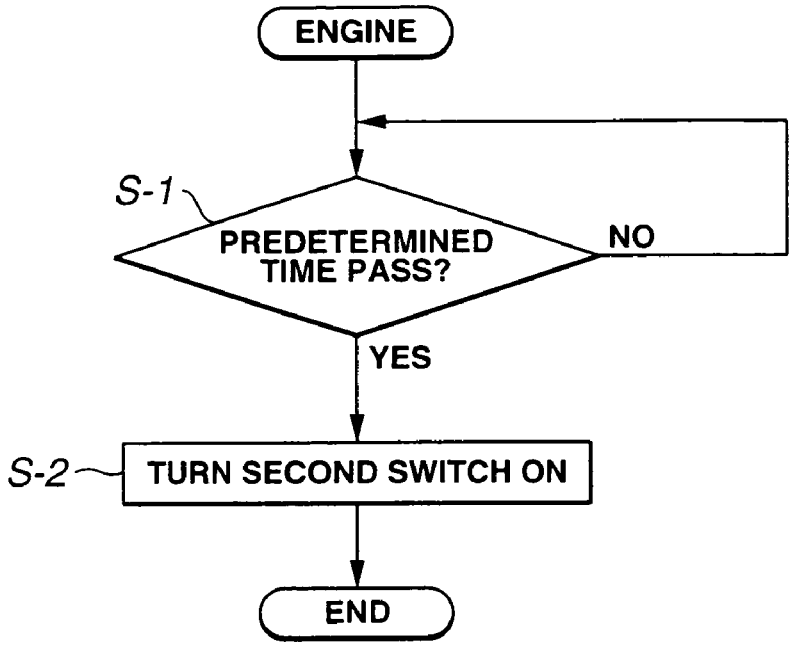
FIG. 14 is a flowchart showing programmed operation steps of a first example executed by a control unit, by which the timing of disengaging a second engaging pin from a second engaging recess is determined.

In FIG. 14, there is shown a flowchart for the first method.

In this method, at step S-1, judgment is carried out as to whether or not a predetermined time has passed after starting of the engine. If YES, that is, if the predetermined time has passed, the operation flow goes to step S-2 to cause second electromagnetic switch 36 to take a condition to feed second pin disengaging chamber 33 with a certain hydraulic pressure for the disengagement of pin 27 from recess 25. In this method, it is possible to estimate the time needed until, upon starting of the engine, three advancing chambers 12 are sufficiently filled with the hydraulic pressure.

Figure 15:
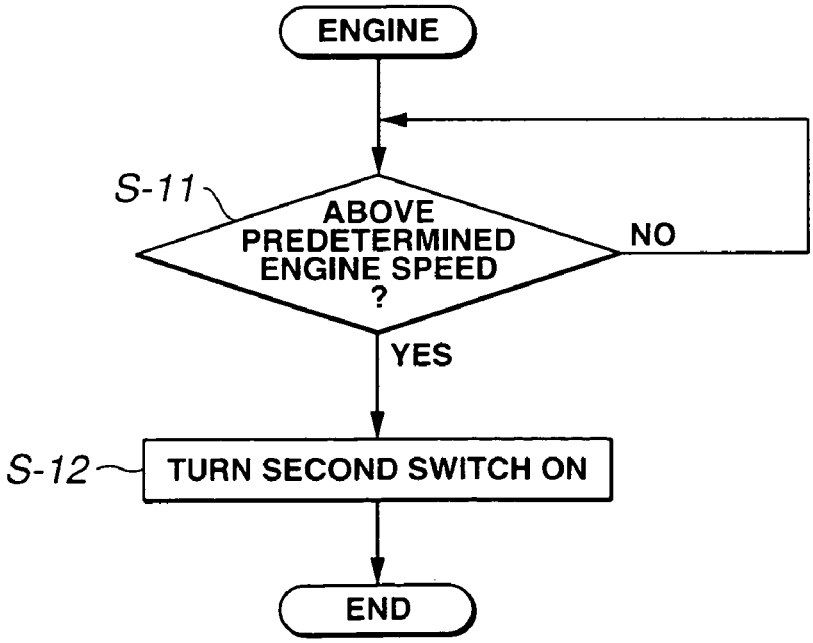
FIG. 15 is a flowchart similar to FIG. 14, but showing a second example.

In FIG. 15, there is shown a flowchart of the second method.

In this method, at step S-11, judgment is carried out as to whether a current engine speed has become higher than a predetermined speed or not. If YES, that is, if the current engine speed has become higher than the predetermined speed, the operation flow goes to step S-12 to cause switch 36 to take the condition to feed chamber 33 with a certain hydraulic pressure for the disengagement of pin 27 from recess 25. Under operation of the engine, oil pump 20 is sufficiently driven. Thus, in this second method, three advancing chambers 12 can be filled quickly with the hydraulic pressure upon starting of the engine.

Figure 16:
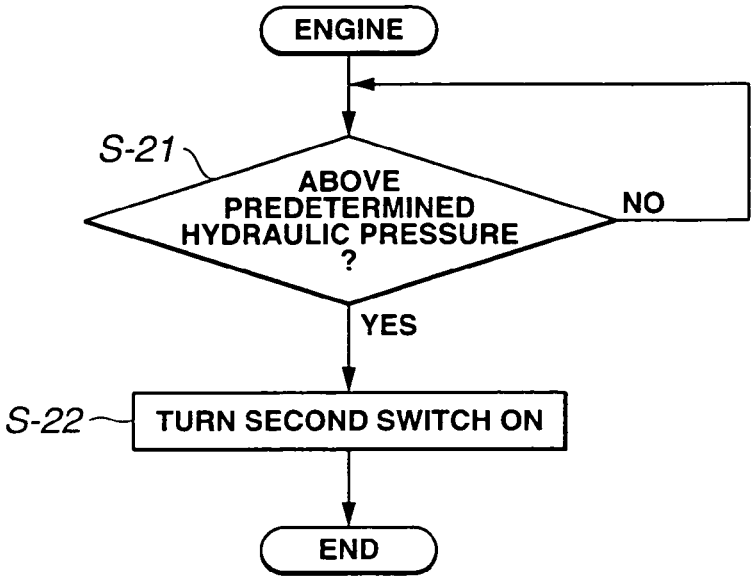
FIG. 16 is a flowchart similar to FIG. 14, but showing a third example.

In FIG. 16, there is shown a flowchart of the third method.

In this method, at step S-21, judgment is carried out as to whether the hydraulic pressure supplied to three advancing chambers 12 has become higher than a predetermined pressure or not. If YES, that is, if the pressure in chambers 12 has become higher than the predetermined pressure, the operation flow goes to step S-22 to cause switch 36 to take the condition to feed chamber 33 with a certain hydraulic pressure for the disengagement of pin 27 from recess 25. According to this third method, the hydraulic pressure led to first engaging recess 24 from one advancing chamber 12 through connecting passage 42 becomes high, and thus, the force by which leading end 26*b* of first engaging pin 26 is pressed against side wall of first engaging recess 24 is increased. Thus, unexpected disengagement of first pin 26 from recess 24 is suppressed.

Figure 17:
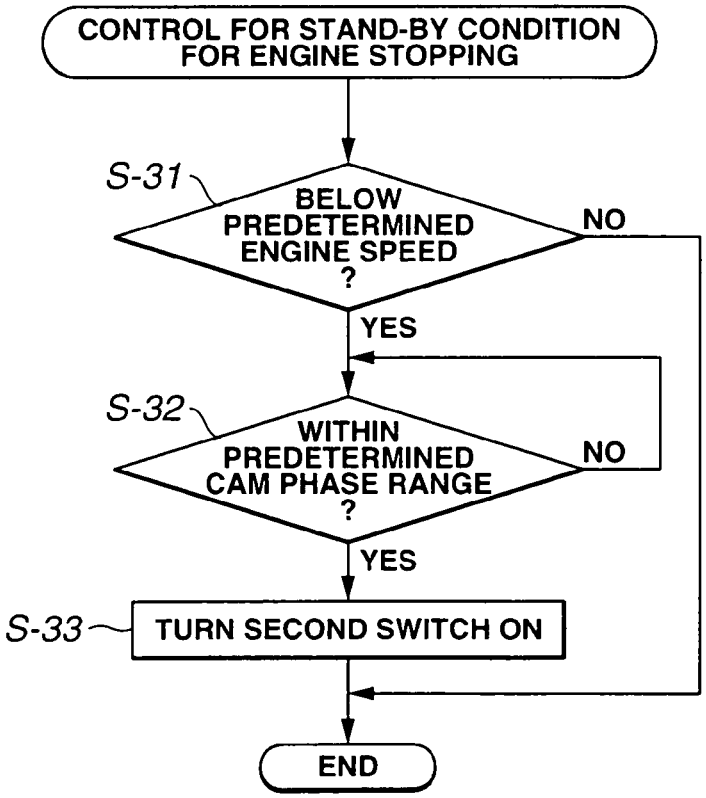
FIG. 17 is a flowchart showing programmed operation steps that are executed by the control unit when the engine takes a stand-by condition for stopping.

FIG. 17 shows programmed operation steps executed by the control unit for carrying out the control for stand-by condition for engine stopping that is depicted by FIG. 12.

That is, at step S-31, judgment is carried out as to whether the current engine speed is lower than a predetermined speed or not. If YES, that is, if the current engine speed is lower than the predetermined speed, the operation flow goes to step S-32. At this step S-32, judgment is carried out as to whether a rotation angle (or cam phase) of intake camshaft 2 is within a predetermined range or not. If YES, the operation flow goes to step S-33 to cause switch 36 to take a condition to feed pin engaging chamber 31 with a certain hydraulic pressure from output passage 20*a* of oil pump 20. With this, first engaging pin 26 is brought into engagement with first engaging recess 24 to achieve a locked engagement therebetween.

The entire contents of Japanese Patent Application 2004-187186 filed Jun. 25, 2004 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A valve timing control device of an internal combustion engine, comprising:

a rotational member that is to be driven by a crankshaft of the engine;

a camshaft having thereon cam lobes for operating engine valves;

a housing provided by one of the rotational member and the camshaft, the housing having hydraulic chambers defined therein;

a vane member provided by the other of the rotational member and the camshaft and rotatably received in the housing, the vane member having vanes each being received in one of the hydraulic chambers to divide the same into a retarding chamber and an advancing chamber, the vane member being rotatable between the most retarded position and the most advanced position over a center position therebetween;

a hydraulic circuit constructed to selectively feed a hydraulic pressure to the retarding and advancing chambers to turn the vane member in a retarding or advancing direction relative to the housing;

an oil pump driven by the engine for producing the hydraulic pressure;

first and second projectable members each being held by one of the housing and the vane member and biased to project toward the other of the housing and the vane member;

a first engaging portion that, when engaged with the first projectable member, restricts a rotational movement of the vane member from the center position in the advancing direction and permits a rotational movement of the same by a given degree from the center position in the retarding direction;

a second engaging portion that, when engaged with the second projectable member, restricts a rotation movement of the vane member from the center position in the retarding direction and permits a rotational movement of the same by a given degree from the center position in the advancing direction;

a first disengaging mechanism that cancels the engagement of the first projectable member with the first engaging portion when hydraulically actuated;

a second disengaging mechanism that cancels the engagement of the second projectable member with the second engaging portion when hydraulically actuated; and a control means that is configured to carry out:

feeding one of the retarding and advancing chambers with a hydraulic pressure upon starting of the engine;

actuating one of the first and second disengaging mechanisms to cancel the engagement of one of the first and second projectable members with the corresponding one of the first and second engaging portions;

feeding the other of the retarding and advancing chambers with a hydraulic pressure thereby to turn the vane member in the housing within a range determined by each of the first and second engaging portions; and actuating, while the vane member is under the rotational movement within the range, the other of the first and second disengaging mechanisms to cancel the engagement of the other of the first and second projectable members with the corresponding one of the first and second engaging portions.

2. A valve timing control device as claimed in claim 1, in which the control means is configured to actuate the second disengaging Mechanism for canceling the engagement of the second projectable member with the second engaging portion upon sensing passage of a predetermined time from an ON operation of an ignition switch of the engine.

3. A valve timing control device as claimed in claim 1, in which the control means is configured to actuate the second disengaging mechanism for canceling the engagement of the second projectable member with the second engaging portion upon sensing starting of the engine.

4. A valve timing control device as claimed in claim 1, in which the control means is configured to actuate the second disengaging mechanism for canceling the engagement of the second projectable member with the second engaging portion upon sensing that the hydraulic pressure fed to one of the retarding and advancing chambers is higher than a predetermined level.

5. A valve timing control device as claimed in claim 1, in which the control means is configured to engage the first projectable member with the first engaging portion by a force of the hydraulic pressure produced by the oil pump, upon sensing that an ignition switch of the engine is turned off.

6. A valve timing control device as claimed in claim 1, further comprising a spring by which the vane member is biased toward the center position.

7. A valve timing control device as claimed in claim 1, in which the control means comprises:

a first electromagnetic switch that controls the first disengaging mechanism, the first electromagnetic switch being of a proportional type; and a second electromagnetic switch that controls the second disengaging mechanism, the second electromagnetic switch being of an ON/OFF type.

8. A valve timing control device of an internal combustion engine, comprising:

a rotational member that is to be driven by a crankshaft of the engine;

a camshaft having thereon cam lobes for operating engine valves;

a housing provided by one of the rotational member and the camshaft, the housing having hydraulic chambers defined therein;

a vane member provided by the other of the rotational member and the camshaft and rotatably received in the housing, the vane member having vanes each being received in one of the hydraulic chambers to divide the same into a retarding chamber and an advancing chamber, the vane member being rotatable between the most retarded position and the most advanced position over a center position therebetween;

a hydraulic circuit constructed to selectively feed a hydraulic pressure to the retarding and advancing chambers to turn the vane member in a retarding or advancing direction relative to the housing;

an oil pump driven by the engine for producing the hydraulic pressure;

first and second projectable members each being held by one of the housing and the vane member and biased by a biasing member to project toward the other of the housing and the vane member;

a first engaging recess that, when engaged with the first projectable member, restricts a rotational movement of the vane member from the center position in the advancing direction and permits a rotational movement of the same by a given degree from the center position in the retarding direction;

a second engaging recess that, when engaged with the second projectable member, restricts a rotational member of the vane member from the center position in the retarding direction and permits a rotational movement of the same by a given degree from the center position in the advancing direction;

a biasing mechanism that is provided by at least one of the second projectable member and the second engaging recess, the biasing mechanism pressing the first projectable member against one wall of the first engaging recess when the second projectable member is brought into engagement with the second engaging recess with the aid of the biasing member;

a first disengaging mechanism that cancels the engagement of the first projectable member with the first engaging recess by using the hydraulic pressure fed to the retarding chambers;

a second engaging mechanism that cancels the engagement of the second projectable member with the second engaging recess by using a hydraulic pressure applied thereto; and a control means that is configured to carry out:

feeding the advancing chambers with a hydraulic pressure upon starting of the engine;

actuating the second disengaging mechanism to cancel the engagement of the second projectable member with the second engaging recess;

feeding the retarding chambers with a hydraulic pressure; and actuating the first disengaging mechanism to cancel the engagement of the first projectable member with the first engaging recess.

9. A valve timing control device as claimed in claim 8, in which the biasing mechanism comprises:

a first tapered surface formed on the second projectable member; and a second tapered surface provided by the second engaging recess, wherein the first tapered surface is frictionally engageable with the second tapered surface when the second projectable member is brought into engagement with the second engaging recess.

10. A valve timing control device as claimed in claim 8, in which the first projectable member comprises:

a flat top surface that is pressed against a bottom surface of the first engaging recess when the first projectable member is pressed against the first engaging recess; and a side surface that is perpendicular to the flat top surface, the side surface being pressed against the wall of the first engaging recess when the vane member rotates in a given direction in the housing.

11. A valve timing control device as claimed in claim 10, in which the first projectable member is a cylindrical pin with a larger diameter land portion, the land portion severing as a pressure receiving part.

12. A valve timing control device as claimed in claim 11, in which the first engaging recess is communicated with the advancing chambers through a connecting passage.

13. A valve timing control device as claimed in claim 8, in which the control means is configured to actuate the second disengaging mechanism for canceling the engagement of the second projectable member with the second engaging recess upon sensing passage of a predetermined time from an ON operation of an ignition switch of the engine.

14. A valve timing control device as claimed in claim 8, in which the control means is configured to actuate the second disengaging mechanism for canceling the engagement of the second projectable member with the second engaging recess upon sensing starting of the engine.

15. A valve timing control device as claimed in claim 8, in which the control means is configured to actuate the second disengaging means for canceling the engagement of the second projectable member with the second engaging recess upon sensing that the hydraulic pressured fed to one of the retarding and advancing chambers is higher than a predetermined level.

16. A valve timing control device as claimed in claim 8, in which the control means is configured to engage the first projectable member with the first engaging recess by a force of the hydraulic pressure produced by the oil pump, upon sensing that an ignition switch of the engine is turned off.

17. A valve timing control device as claimed in claim 8, further comprises a spring by which the vane member is biased toward the center position.

18. A valve timing control device as claimed in claim 8, in which the control means comprises:

a first electromagnetic switch that controls the first disengaging mechanism, the first electromagnetic switch being of a proportional type; and a second electromagnetic switch that controls the second disengaging mechanism, the second electromagnetic switch being of an ON/OFF type.

19. A valve timing control device of an internal combustion engine, comprising:

a rotational member that is to be driven by a crankshaft of the engine;

a camshaft having thereon cam lobes for operating engine valves;

a housing provided by one of the rotational member and the camshaft, the housing having hydraulic chambers defined therein;

a vane member provided by the other of the rotational member and the camshaft and rotatably received in the housing, the vane member having vanes each being received in one of the hydraulic chambers to divide the same into a retarding chamber and an advancing chamber, the vane member being rotatable between the most retarded position and the most advanced position over a center position therebetween;

a hydraulic circuit constructed to selectively feed a hydraulic pressure to the retarding and advancing chambers to turn the vane member in a retarding or advancing direction relative to the housing;

an oil pump driven by the engine for producing the hydraulic pressure;

first and second projectable members each being held by one of the housing and the vane member and biased to project toward the other of the housing and the vane member;

a first engaging means for, when engaged with the first projectable member, restricting a rotational movement of the vane member from the center position in the advancing direction and permitting a rotational movement of the same by a given degree from the center position in the retarding direction;

a second engaging means for, when engaged with the second projectable member, restricting a rotation movement of the vane member from the center position in the retarding direction and permitting a rotational movement of the same by a given degree from the center position in the advancing direction;

a first disengaging means for canceling the engagement of the first projectable member with the first engaging means when hydraulically actuated;

a second disengaging means for canceling the engagement of the second projectable member with the second engaging means when hydraulically actuated; and a control means that is configured to carry out:

feeding one of the retarding and advancing chambers with a hydraulic pressure upon starting of the engine;

actuating one of the first and second disengaging means to cancel the engagement of one of the first and second projectable members with the corresponding one of the first and second engaging means;

feeding the other of the retarding and advancing chambers with a hydraulic pressure thereby to turn the vane member in the housing within a range determined by each of the first and second engaging means; and actuating, while the vane member is under the rotational movement within the range, the other of the first and second disengaging means to cancel the engagement of the other of the first and second projectable members with the corresponding one of the first and second engaging means.

20. A valve timing control device as claimed in claim 19, further comprising a spring by which the vane member is biased toward the center position.

* * * * *